United States Patent [19]

Weber

[11] Patent Number: 4,818,237

[45] Date of Patent: Apr. 4, 1989

[54] MODULAR PLUG-IN CONNECTION MEANS FOR FLEXIBLE POWER SUPPLY OF ELECTRONIC APPARATUS

[75] Inventor: Ronald M. Weber, Lebanon, Pa.

[73] Assignee: AMP Incorporated, Harrisburg, Pa.

[21] Appl. No.: 91,973

[22] Filed: Sep. 4, 1987

[51] Int. Cl.[4] ..... H01R 13/04

[52] U.S. Cl. ..... 439/693; 439/677; 439/55

[58] Field of Search ..... 439/135–150, 439/284, 295, 350, 351, 353, 354, 668, 677–680, 689, 709, 712, 715, 716, 717, 607, 609, 610, 668, 669, 693, 55

[56] References Cited

U.S. PATENT DOCUMENTS

| | | | |
|---|---|---|---|
| 2,724,814 | 9/1952 | Stubbers | 339/198 |
| 3,437,983 | 4/1969 | Gilissen | 339/198 |
| 3,491,330 | 9/1967 | Barnhart et al. | 339/186 M |
| 3,627,942 | 12/1971 | Bobb | 200/51.07 |
| 3,697,933 | 10/1972 | Black et al. | 439/80 |
| 3,742,424 | 6/1973 | Startin | 439/678 |
| 3,753,216 | 8/1973 | Johnson et al. | 339/198 GA |
| 3,760,336 | 9/1973 | Cerwin | 339/92 M |
| 3,884,544 | 5/1975 | Lundergan et al. | 339/198 G |
| 3,963,296 | 6/1976 | Glover et al. | 339/75 M |
| 4,046,452 | 9/1977 | Gassarly | 339/198 H |
| 4,171,862 | 10/1979 | Krasser | 339/198 H |
| 4,178,545 | 12/1979 | Kneifel | 324/158 F |
| 4,211,461 | 7/1980 | Wescott | 439/680 |
| 4,235,502 | 11/1980 | Marks et al. | 439/139 |
| 4,258,970 | 3/1981 | Bourdon | 439/149 |
| 4,449,767 | 5/1984 | Weidler | 339/17 LC |
| 4,451,107 | 5/1984 | Dola et al. | 339/143 R |
| 4,469,393 | 9/1984 | Chewning, Jr. et al. | 439/717 |
| 4,477,022 | 10/1984 | Shuey et al. | 339/59 M |
| 4,555,153 | 11/1985 | Bricaud et al. | 339/17 CF |
| 4,650,270 | 3/1987 | Tajima et al. | 439/607 |

FOREIGN PATENT DOCUMENTS

| | | |
|---|---|---|
| 0246750 | 4/1987 | European Pat. Off. . |
| 3644038 | 6/1987 | Fed. Rep. of Germany . |
| 2493051 | 2/1969 | France . |
| 1575701 | 12/1969 | France . |
| 59-16155 | 1/1984 | Japan . |
| 6535/66 | 8/1985 | Japan . |

OTHER PUBLICATIONS

U.S. patent application Ser. No. 855,225 abandoned and continued in Ser. No. 07/178,786 Weber.

U.S. patent application Ser. No. 907,703 Weber et al.

U.S. patent application Ser. No. 907,696, Weber et al.

Elcon Domino TM System, "A Modular High Current Connector System".

AMP Power Lock Connector data sheet #75–339, pp. 1–6; IS2597 & IS2624.

*Primary Examiner*—David Pirlot

*Attorney, Agent, or Firm*—Katherine A. Nelson

[57] ABSTRACT

A flexible power distribution system comprises a modular electrical connector assembly (10) has complete plug-in connections between a power supply and a "mother" board (12) or backplane which carries a plurality of "daughter" PC boards (13). The system includes a male contact member (30) in a receptacle (15) adapted to be received within a female contact member (45) in a plug (14), when the plug (14) is slidably inserted into the receptacle (15). Respective guard means are provided to prevent one's finger from being inserted into either the plug (14) or receptacle (15), respectively, to contact the female and male contact members therein; and the respective guard means mesh therebetween when plug (14) is inserted into receptacle (15). Male contact member (30) includes a plurality of relatively long and narrow compliant beam contact elements (35), each of which is provided with a coined spherical tip (36) engaging the female contact member, thereby compensating for any torsional stresses on the contact elements. Means are provided for interlocking adjacent modules together in a side-by-side stacked array on a respective PC board.

19 Claims, 12 Drawing Sheets

MODULAR PLUG-IN CONNECTION MEANS FOR FLEXIBLE POWER SUPPLY OF ELECTRONIC APPARATUS

FIELD OF THE INVENTION

The present invention relates to modular connection means for electronic apparatus, and more particularly, to modular plug-in connection means for a flexible power supply, D.C.-to-D.C. converter, or the like included in such apparatus.

BACKGROUND OF THE INVENTION

In various electronic apparatus, such as computer systems and printed circuit ("PC") boards which include logic circuitry, a backplane or "mother" board is employed. The "mother" board has a plurality of subsidiary "daughter" boards mounted thereon, usually at right angles thereto. Electrical power is provided to the "mother board" by a separate power supply, and the power supply has cables or bus bars leading to the "mother" board.

While sufficient for the purposes intended, nevertheless, these prior art arrangements are somewhat cumbersome and inconvenient and are inherently inflexible. With the advent of higher complexity and speed of data processing and increasingly dense semiconductor packaging the need for power distribution onto mother boards and even down to the daughter board level, has gradually arisen. Difficulty, however, has been encountered in adapting existing power type connectors and screw-down terminals to the electronic packaging. The large terminal lugs utilized for power suppliers of a few years age and the associated connectors heretofore used are simply too large, too cumbersome, and too difficult to use to satisfy present packaging requirements.

One means to distribute power between printed circuit boards is the programmable modular connector assembly disclosed in U.S. patent application Ser. No. 06/855,255, abandoned continued Ser. No. 07/178,786 owned by this assignee. The programmable modular connector assembly is comprised of modules which interlock with each other to form intermating halves of a connector assembly with different style modules for different power levels.

Since these modules may include contacts that carry high current, it is desirable that means be provided in the module to assure that one's finger cannot be inserted into a module to engage the respective contacts therein.

In such a system, it is also desirable to have means to assure that the effects of manufacturing tolerances are minimized and that each of the modules are essentially self centering.

SUMMARY OF THE INVENTION

Accordingly, it is an object of the present invention to provide a flexible power supply means for electronic apparatus of the type described, wherein the respective connections are completely plug-in, and wherein the wires, cables or bus bars (habitually resorted to in the prior art) are eliminated.

It is another object of the present invention to provide modular connectors having respective contact members therein, wherein means are provided to assure that one's finger cannot be inserted into the connectors to engage the respective contacts therein.

It is a further object of the present invention to provide a modular power supply means which is inherently flexible, self-centering, reliable, easily serviceable, and substantially reduces manufacturing tolerances for reduced costs of production and assembly.

It is yet another object of the present invention to provide flexible power supply means including respective modular connectors which may be slidably latched together in a side-by-side stacked array.

In accordance with the teachings of the present invention, there is herein illustrated and disclosed (in an electronic apparatus of the character described) a means for distributing power to the various components of the apparatus through a modular connector assembly comprised of a plurality of matable modules having different power and signal carrying characteristics. The receptacle modules having the male contact members therein are attached to a backplane or mother board. The corresponding plug modules having the female contact members therein are mounted in juxtaposition to the receptacles. The plug modules are attached to the various components that supply, transform or use power including anything that was previously wired into the system, such as cooling fans, battery backup units, disc drives and the like as well as power supplies. For purposes of brevity, the components previously described will hereinafter be referred to as a power supply. The modular connector assembly also included receptacle and plug modules having signal contacts therein, which interconnect, for example, the mother board to the daughter boards.

The present invention is particularly directed to power plug and receptacle modules, hereinafter referred to as plugs and receptacles. The female contact members in the plugs have plug-in connection means extending through the plug and adapted to make electrical engagement with the respective contacts in the receptacles. The receptacles are adapted to slidably receive corresponding plugs and male contact members in the receptacles are adapted to engage corresponding female contact members in the plugs when the plugs are slidably received within the receptacles. This structure provides complete plug-in connections from the power supply to the "mother" board and distribution to the "daughter" boards or other components without the necessity for cable or bus bar connections therebetween.

There is further provided, consonant with the teachings of the present invention, a guard means for preventing the insertion of a finger to engage the contact member in the plug and receptacle, respectively.

In accordance with the still further teachings of the present invention, there is herein illustrated and described a preferred embodiment thereof, wherein a receptacle is formed from an insulative material and has a forward open end. A male contact member formed from a conductive material is secured within the receptacle. The male contact member has a plurality of contact elements extending forwardly within the receptacle and terminating prior to the forward open end of the receptacle. A first guard means is carried by the receptacle,. extends substantially adjacent to the forward open end thereof, and is disposed within the plurality of contact elements of the male contact member. This first guard means prevents insertion of a finger through the forward open end of the receptacle to engage the male contact member therein.

A plug formed from an insulative material is adapted to be slidably received and partially nested within the receptacle. The plug has a forward open end, and a female contact member formed from a conductive material is secured within the plug. The female contact member has a forward portion terminating prior to the forward open end of the plug. A second guard means is carried by the plug substantially between the forward portion of the female contact member and the forward open end of the plug. This second guard means prevents the insertion of a finger through the forward open end of the plug to engage the female contact member therein. As the plug is slidably received within the receptacle, the first guard means on the receptacle is received within and passes through the second guard means on the plug; and the contact elements on the male contact member in the receptacle are received within the open forward end of the plug, are deflected inwardly thereof, and pass through the second guard means on the plug to be received within and engage the forward portion of the female contact member in the plug.

Preferably, the plurality of contact elements comprise a plurality of spring finger contacts, each of which is formed as a cantilevered compliant beam. In the preferred embodiment, there are eight spring finger contacts arranged in a rectangular array having four sides, a pair of spring finger contacts being disposed at each side of the rectangular array.

In addition, a plurality of solder posts is formed integrally with the male contact member and extends rearwardly thereof. The receptacle is adapted to be mounted on a backplane, and the backplane has a plurality of openings formed therein to receive the respective plurality of solder posts on the male contact member in the receptacle.

Preferably, the first guard means includes a cylindrical sleeve disposed within the receptacle. The cylindrical sleeve has a rearward end portion within the receptacle, and a plurality of struts integrally join the rearward end portion of the cylindrical sleeve with the receptacle.

The receptacle has a rectangular cross-section including four side walls joined together at four corners, respectively. In the preferred embodiment, there are four struts spaced substantially at ninety degrees with respect to each other; and the struts are integrally joined with the receptacle at the corners thereof, whereby respective pairs of spring finger contacts are disposed between adjacent struts. Each side wall of the rectangular receptacle has an internal longitudinal rib formed thereon rearwardly of the struts; and the longitudinal ribs engage respective lanced-out tabs on the male contact member with a light interference fit therebetween, thereby retaining the male contact member within the receptacle.

In the preferred embodiment, the plug has an internal ledge formed therein rearwardly of the second guard means in the plug, and the forward portion of the female contact member engages the internal ledge to limit the insertion of the female contact member within the plug. The plug has a rectangular cross-section including respective walls joined at four corners, respectively, and including a bottom wall. The female contact member has a rectangular cross-section including four walls (complementary to the cross-section of the plug) and including two parallel side walls. The two parallel side walls of the female contact member are provided with respective lanced-out retention barbs depending downwardly and rearwardly of the female contact member and engaging the bottom wall of the plug. The two parallel side walls of the female contact member are further provided with respective lanced-out stabilizing portions forwardly of the respective retention barbs. Each of the stabilizing portions is formed on a radius disposed convexly with respect to the bottom wall of the plug, such that the respective stabilizing portions substantially prevent a rocking movement of the female contact member about a transverse axis between the respective retention barbs.

Preferably, the second guard means on the plug includes a plurality of second struts integrally joined with the four corners of the plug. In the preferred embodiment, there are four of the second struts spaced at substantially ninety degrees from one another, and respective pairs of spring finger contacts of the male contact member are received between respective pairs of the second struts, when the plug and receptacle are slidably mated. Additionally, the cylindrical sleeve of the first guard means has a plurality of longitudinal slots formed therein, the slots being circumferentially spaced substantially at ninety degrees from one another to receive the respective second struts on the second guard means, as the plug is slidably received into the receptacle.

Preferably, the bottom wall of the plug has an opening formed therein rearwardly of the engagement between the retention barbs and the bottom wall of the plug. The female contact member has a plurality of depending solder posts projecting through the opening in the bottom wall of the plug, and the power supply board has a complementary plurality of openings formed therein to receive the plurality of solder posts on the female contact member, respectively. At least one retention member, preferably a compliant pin of the type disclosed in U.S. Pat. No. 4,186,192 is carried by the female contact member and projects through the opening in the bottom wall of the plug forwardly of the plurality of depending solder posts. The power supply board has an opening formed therein to receive the retention member, and the retention member has means thereon for engaging the opening in the power supply board to provide for mechanical rigidity between the plug and the power supply board.

Preferably, the plug has an open rearward end to receive the female contact member, and a cap is secured to the plug to cover the open rearward end thereof. The female contact member has a pair of rearwardly-projecting barbs formed thereon for engaging the cap, and the cap is ultrasonically welded to the plug.

Viewed in another aspect, the present invention provides an assembly for electronic equipment which includes, in combination, a receptacle formed from an insulative material. A male contact means formed from a conductive material is disposed within the receptacle. A plug is formed from an insulative material, and a female contact means formed from a conductive material is disposed within the plug. The male and female contact means are adapted to engage when the plug is slidably received within the receptacle. A first guard means on the receptacle prevents a finger from engaging the male contact means in the receptacle, and a second guard means on the plug prevents a finger from engaging the female contact means in the plug. The first and second guard means each has means thereon for accommodating the slidable reception of the plug into the receptacle and the subsequent engagement of the male contact means with the female contact means.

Viewed in yet still another aspect, the present invention provides a connector for an electronic assembly. The connector includes a housing molded from a dielectric material, the housing having an open forward end and an open rearward end. A central post is disposed within the housing longitudinally thereof. The post has a forward portion and a rearward portion, the forward portion of the post terminating substantially adjacent to the open forward end of the housing. A plurality of circumferentially-spaced struts integrally joins the rearward portion of the post with the housing. A contact member is inserted through the rearward end of the housing, and means are provided for retaining the contact member within the housing. The contact member has a plurality of cantilevered compliant-beam contact elements extending forwardly therefrom. The contact elements extend through the plurality of circumferentially-spaced struts and are disposed between the central post and the housing.

Preferably, each of the contact elements has an end portion coined to form an arc which is convex with respect to the housing. In the preferred embodiment, there are four struts arranged approximately ninety degrees from each other; and there are eight contact elements arranged in four pairs, a pair of contact elements being disposed between an adjacent pair of struts.

These and other objects of the present invention will become apparent from a reading of the following specification, taken in conjunction with the enclosed drawings.

GENERAL DESCRIPTION OF THE PREFERRED EMBODIMENTS

Figure 1:
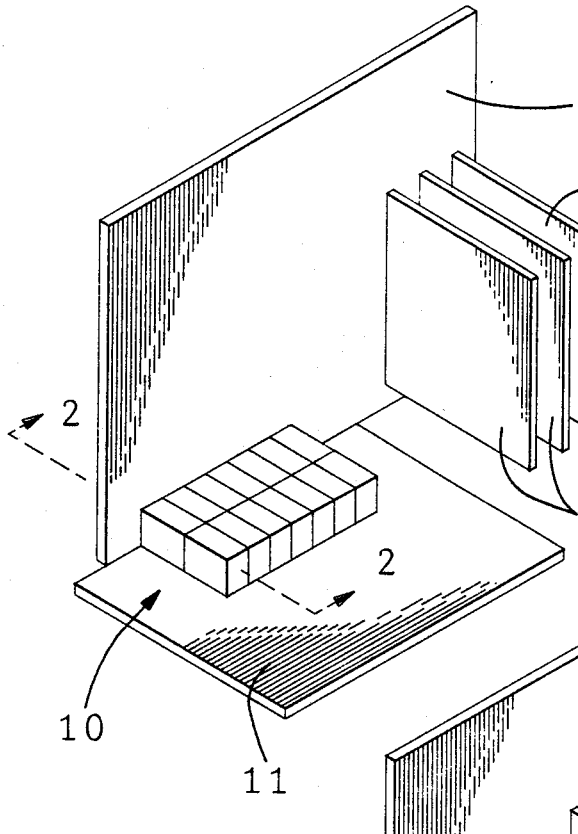
FIG. 1 is a schematic pictorial view of a power supply board, "mother" board or backplane, a plurality of "daughter" boards on the mother board, and the flexible modular power supply means of the present invention which provides complete plug-in connections to eliminate the prior art necessity for any cables or bus bars from a power supply to the "mother" board or backplane.
Figure 2:
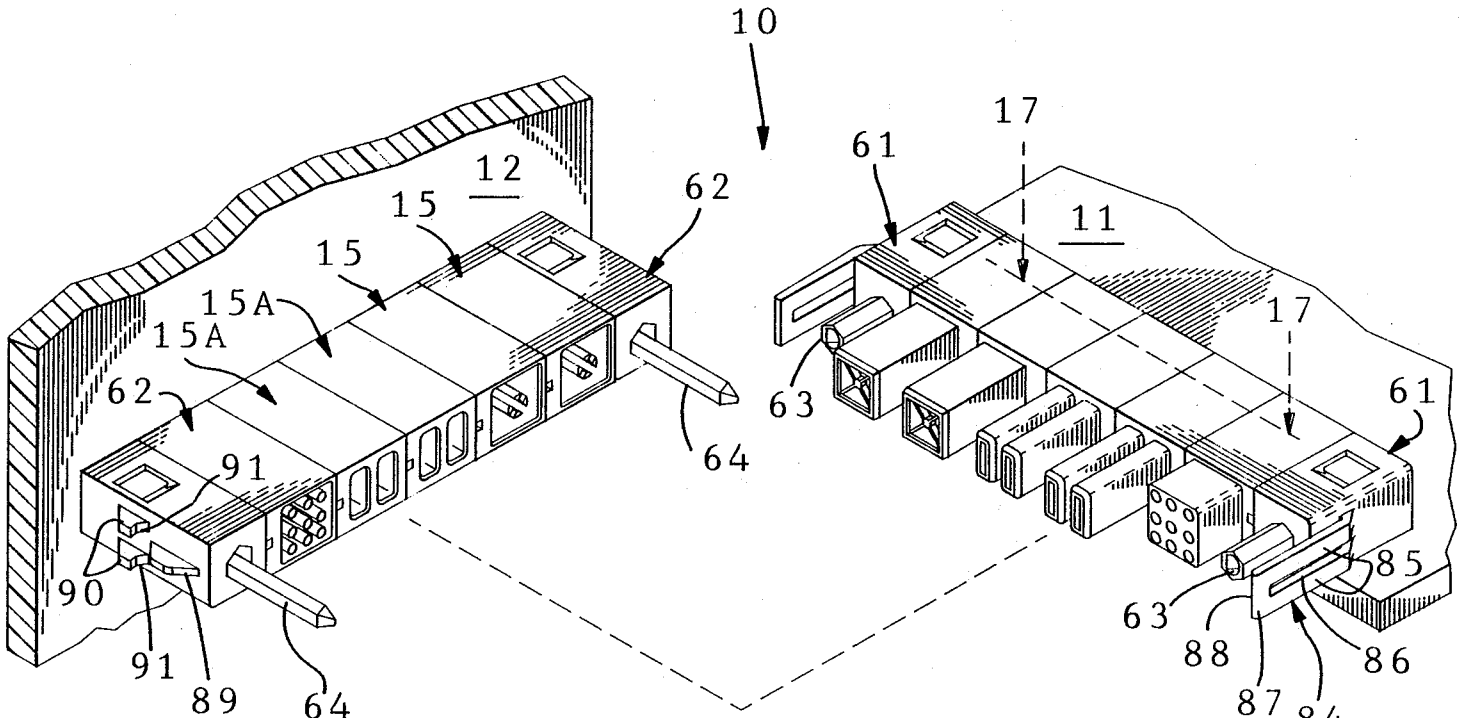
FIG. 2 is an exploded perspective, showing a pair of PC boards, each of which has a plurality of stacked modules thereon.

With reference to FIGS. 1 and 2, there is illustrated schematically the improved flexible power supply comprised of modular connector assembly 10. Assembly 10 is shown in association with a power supply board 11, a "mother" board or backplane 12, and a plurality of "daughter" boards 13 carried by the "mother" board 12. The "daughter" boards 13 may contain the logic circuitry of a computer system, for example, and the "mother" board 12 is adapted to supply electrical power at the desired voltage and current to the respective "daughter" boards 13. However, it will be appreciated by those skilled in the art that the teachings of the present invention are not necessarily confined thereto, but rather could be adapted to other applications, such as D.C.- to -D.C. converters, disc drives, battery backup units, and the like.

With this in mind, modular connector assembly 10 is comprised of a plurality of matable modules having different power and signal carrying characteristics. The modules are arranged in a side-by-side relationship in a stacked array to form matable halves of connector assembly !0. The receptacle modules, shown as 15, 15A and 15B, having the male contact members therein are attached to a backplane or mother board. The corresponding plug modules, shown as 14, 14A and 14B, having the female contact members therein are mounted in juxtaposition to the receptacles. The plug modules are attached to the various components that supply, transform, or use power, including anything that was previously wired into the system such as cooling fans, battery backup units, disk drives, and the like, as well as power supplies. For purposes of brevity, the components previously described will hereinafter be referred to as a power supply. The modular connector assembly also includes receptacle 15B and plug modules 14B having signal contacts therein which interconnect, for example, mother board 12 to daughter boards 13. The size and number of contact members used in the modules varies depending upon the voltage and current requirements of the components. The present invention is directed to modular units which can be used in the modular connector assembly disclosed in U.S. patent application Ser. No. 06/855,255 abandoned and continued in Ser. No. 07/178,786.

FIG. 2 also illustrates that the stacked arrays preferably include a pair of end modules 61,62 which have polarizing features and latching means to secure the modular plug and receptacle units together. Module 62 has a longitudinal key 64 extending therefrom, and the other module 61 has a complementary longitudinal keyway 63 to receive the key 64 on the one module 62. Key 64 and keyway 63 preferably have polygonal cross-sectional configurations which are complementary to each other and are mounted in their respective modules such that their relative orientation may be adjusted. Preferably the polarizing features are of the type disclosed in U.S. patent application Ser. No. 06/907,703 which is herein incorporated by reference.

End modules 61,62 further have latching means comprised of an integrally formed U-shaped latch 84 which extends forwardly from module 61 and an inclined ramp 89 formed integrally on module 62. Latch 84 has bifurcated legs 85 separated by a slot 86. The legs 85 are connected by a bight 87 having a beveled or chamfered forward edge 88 thereon. Rearwardly of ramp 89 on module 62 are a pair of stops 90 formed integrally thereon, the stops 90 having notches 91. When the modules 61 and 62 are slidably keyed together, the beveled edge 88 of the bight 87 engages the inclined ramp 89, thus flexing the latch 84 outwardly until the inclined ramp 89 is received in the slot 86 between the legs 84. Thereafter, the forward beveled edge 88 of the latch 84 is received in the notches 91 of the stops 90, thereby securely latching the modules 61 and 62 flexible.

Figure 1A:
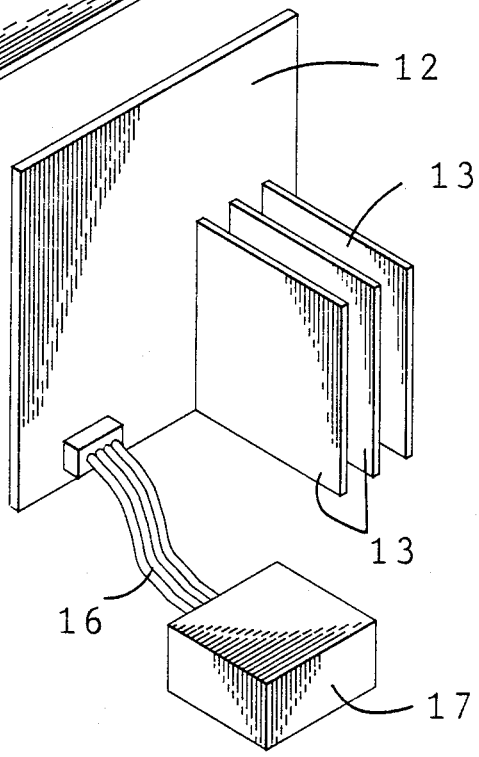
FIG. 1A is a further schematic pictorial view, corresponding to that of FIG. 1, but showing the prior art which necessitates a plurality of cables or bus bars from a power supply chassis rigidly or permanently attached to a "mother" board or backplane, an inherently inflexible arrangement which is both cumbersome and inconvenient.

Accordingly, with this arrangement, all plug-in connections are provided throughout; and the use of wires, cables or bus bars, heretofore required in the prior art, has been eliminated. Thus, a power supply system is provided with inherent flexibility for substantial design freedom, while accommodating installation and service in the field. By comparison, the cumbersome and inconvenient systems of the prior art, as illustrated schematically in FIG. 1A, require a plurality of cables or bus bars 16 between the "mother" board 12 and a power supply chassis 17.

One aspect of the present invention is directed to receptacle and plug modules having safety features which assure that one's finger cannot be inserted into the modules to engage respective contacts therein. Such safety features are required by multinational safety agencies, particularly for connectors which carry high currents and voltages.

Figure 7:
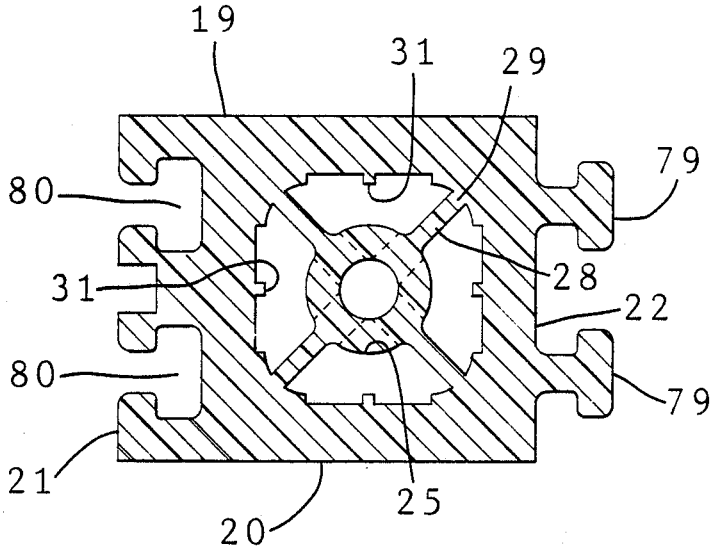
FIG. 7 is a cross-section of the receptacle, taken across the lines 7—7 of FIG. 5, and showing, first, the plurality of circumferentially-spaced slots integrally joining the cylindrical sleeve (or central notched post) and, second, the longitudinal keys and keyways for stacking the modular receptacles in an array.
Figure 8:
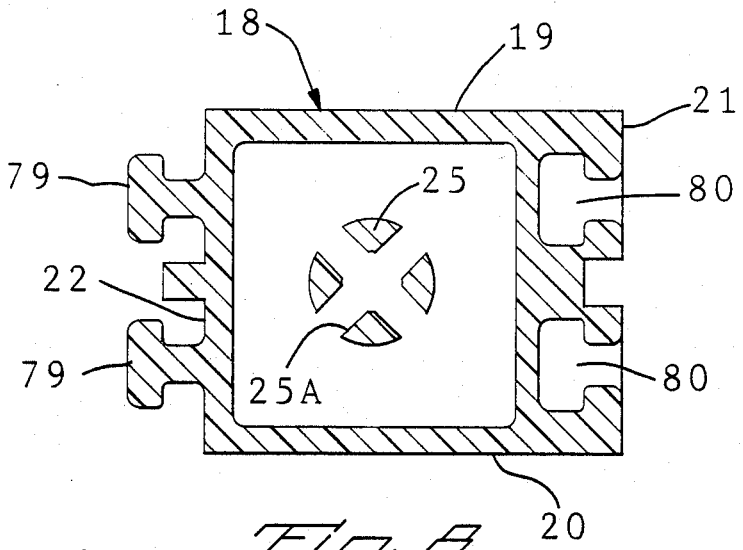
FIG. 8 is a further cross-section of the receptacle, taken across the lines 8—8 of FIG. 7, and showing the cylindrical sleeve with its plurality of circumferentially-spaced slots formed therein to clear the respective struts on the plug, as the plug is slidably inserted into the receptacle.

With reference to FIGS. 3–8, the receptacle 15 includes a housing 18 molded from a suitable dielectric material. The housing 18 is substantially tubular and has a rectangular configuration, including a top wall 19, bottom wall 20, and respective parallel side walls 21 and 22. The housing 18 further has an open forward end 23 and an open rearward end 24 and preferably includes locating posts 83A. A cylindrical sleeve 25 (constituting a notched post) is centrally disposed within the housing 18, extends therewithin, and has a forward portion 26 terminating substantially adjacent to the open forward end 23 of the housing 18. The cylindrical sleeve 25 has a plurality of circumferentially-spaced longitudinal slots 25A and further has a rearward portion 27 integrally joined to the housing 18 by a plurality of struts 28, as best seen in FIG. 7. In the preferred embodiment, there are four struts 28 circumferentially spaced from each other at approximately 90 degrees, as shown more clearly in FIG. 7, and the struts 28 are joined to the respective corners of the housing 18, as at 29. It will be appreciated that the housing 18, cylindrical sleeve 25 and struts 28 comprise an integrally-molded component.

A male contact member 30 is slidably inserted through the open rearward end 24 of the housing 18 for the receptacle 15. Each wall of the housing 18 has a longitudinal ridge 3! (shown more clearly in FIG. 7) which engages balanced-out tab 32 formed on the male contact member 30 (shown more clearly in FIG. 5) thereby retaining the male contact member 30 within the housing 18 of the receptacle 15. The male contact member 30 preferably has a plurality of rearwardly-extending solder posts 33 received in respective openings 34 in the backplane or "mother" board 12. The electrical engagement of the solder posts 33 with the circuitry on the "mother" board 12, being conventional, has been omitted for ease of illustration.

A plurality of spring-finger contact elements 35 are formed on the male contact member 30 and extend forwardly within the receptacle 15. Each of the contact elements 35 constitutes a cantilevered compliant beam, and the end of each contact element 35 is coined to provide a spherical contacting surface, as at 36. When the male contact member 30 is slidably inserted through the open rearward end 24 of the receptacle housing 18, the spring-finger contact elements 35 slide between the struts 28 and are disposed between the cylindrical sleeve 25 and the respective walls of the housing 18 of the receptacle 15, as shown more clearly in FIG. 12. In the preferred embodiment, there are eight (8) spring-finger contact elements 35 arranged in four pairs of two each, each pair on a side, as shown more clearly in FIGS. 4 and 9.

With reference again to FIG. 4, the male contact member 30 is recessed within the receptacle 15, and the cylindrical sleeve 25 constitutes a first guard means which prevents one's finger F from being inserted through the open forward end 23 of the receptacle housing is to engage the male contact member 30.

Figure 4:
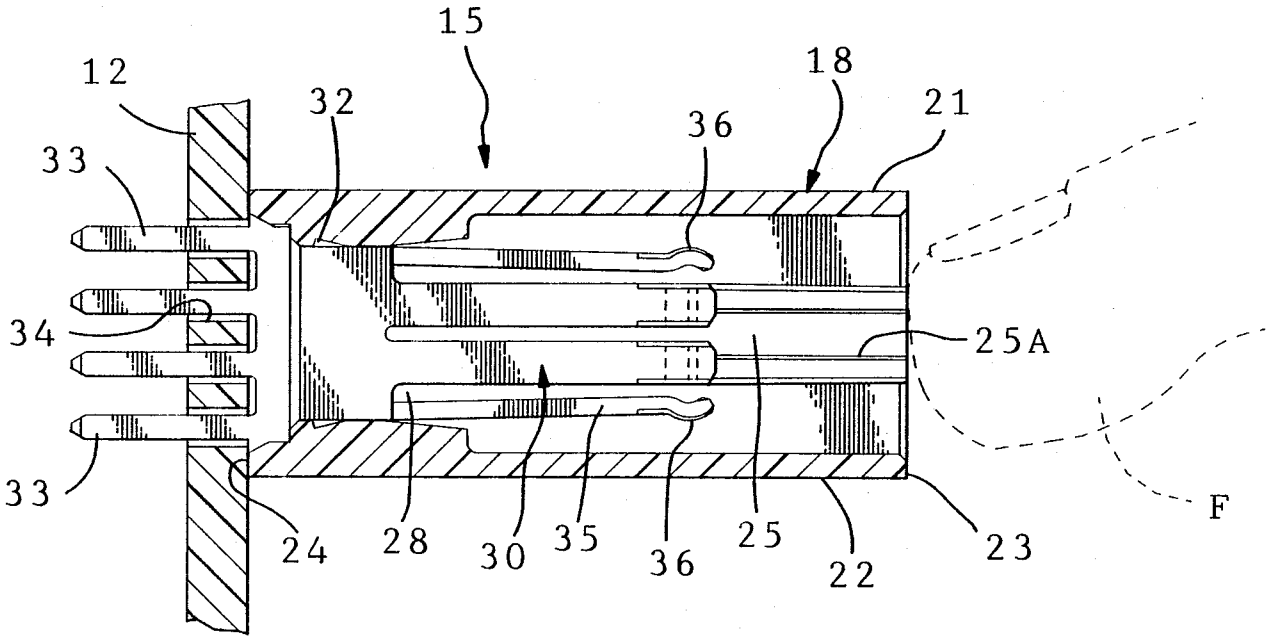
FIG. 4 shows the receptacle of FIG. 3 disassembled from the plug, and further shows a first guard means on the receptacle for preventing one's finger (shown in broken lines) from being inserted through the open forward end of the receptacle to engage the male contact member therein.
Figure 4A:
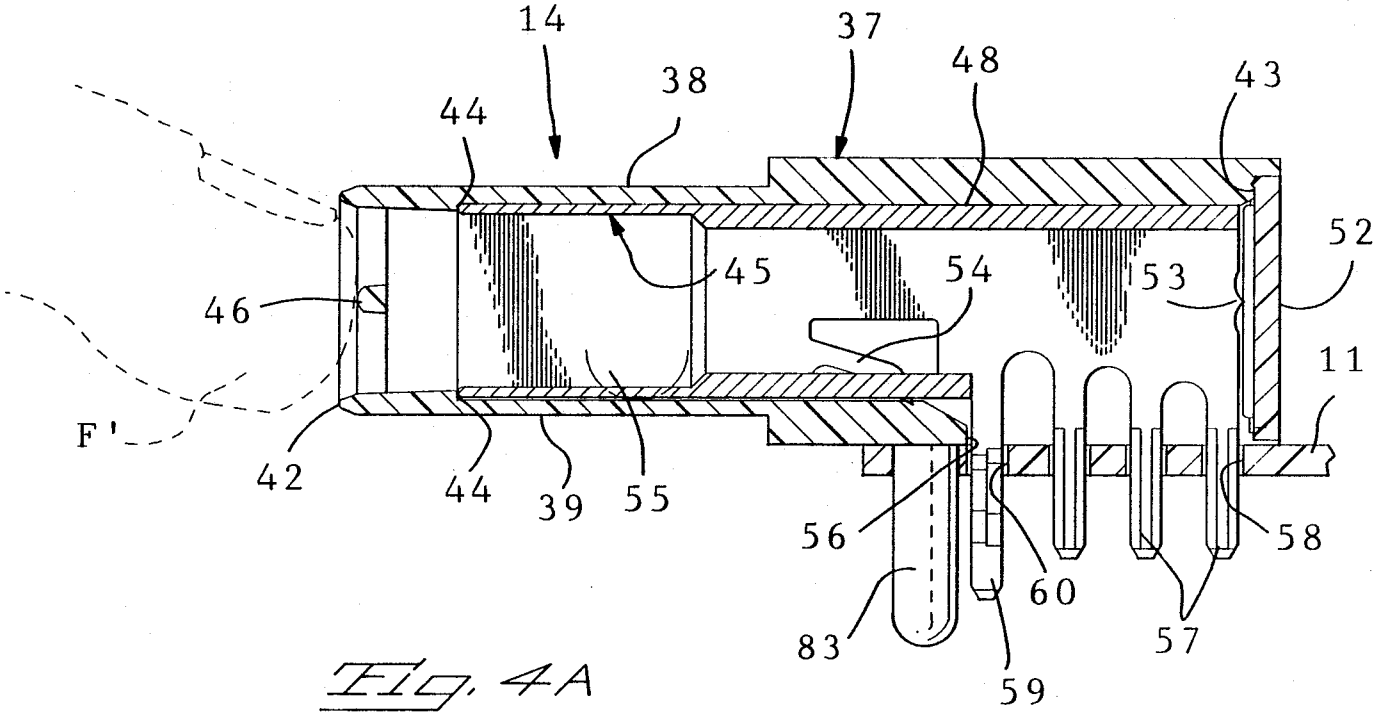
FIG. 4A shows the plug of FIG. 3 disassembled from the receptacle, and further shows a second guard means on the plug for preventing one's finger (shown in broken lines) from being inserted through the open forward end of the plug to engage the female contact member therein.
Figure 5:
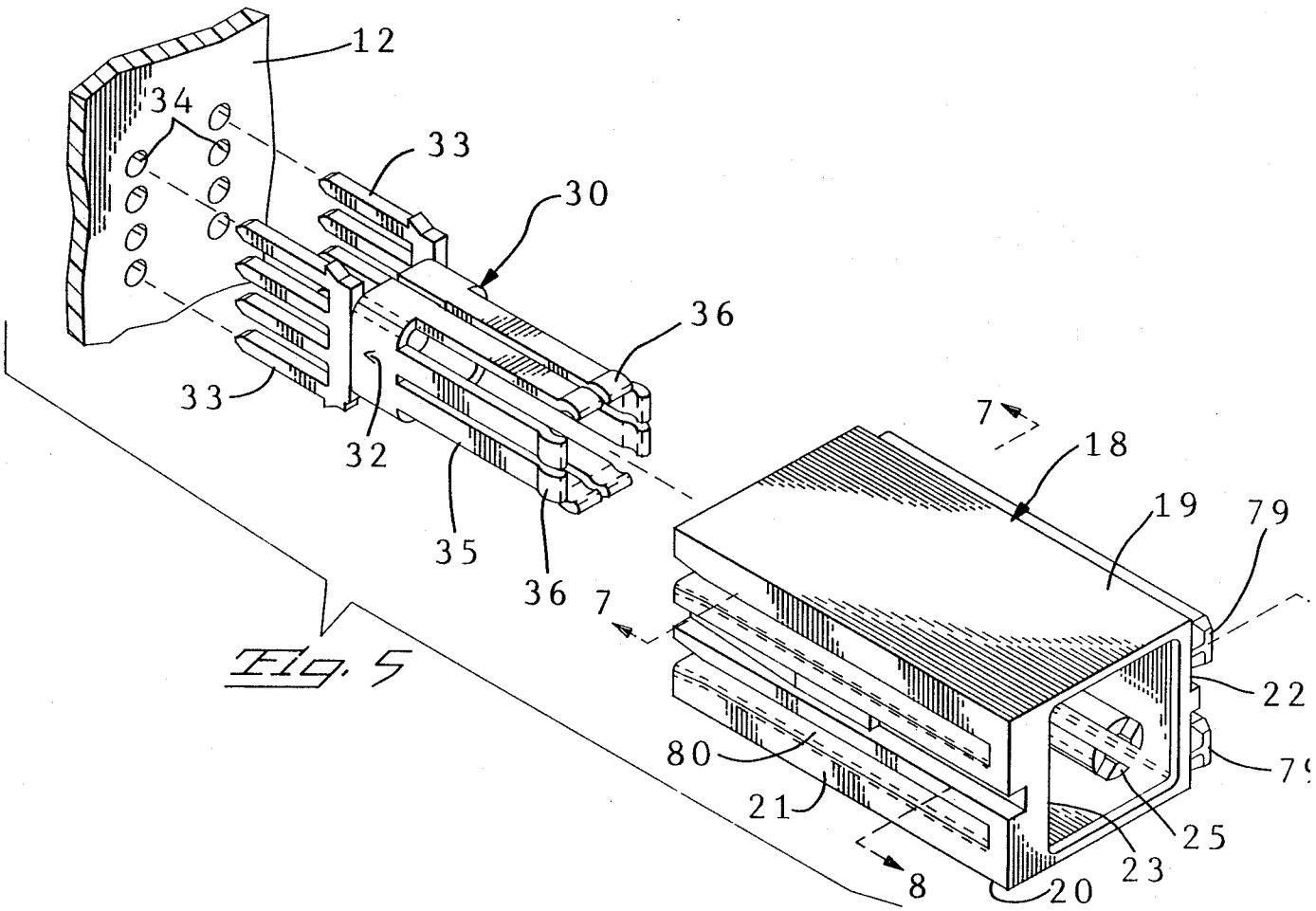
FIG. 5 is an exploded perspective of the receptacle, male contact member, and backplane of the present invention.
Figure 6:
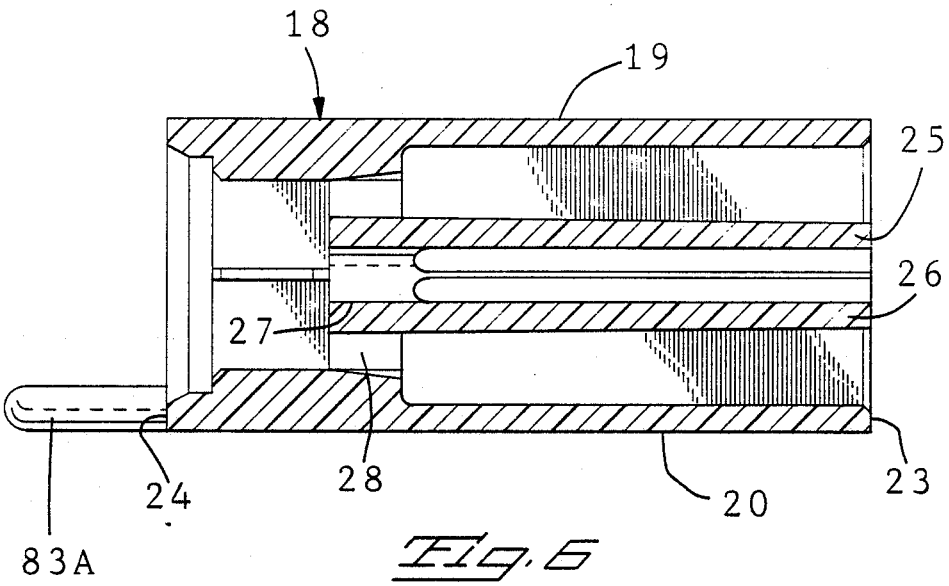
FIG. 6 is a longitudinal section view of the receptacle, taken across the lines 6—6 of FIG. 5.
Figures 9, 9A:
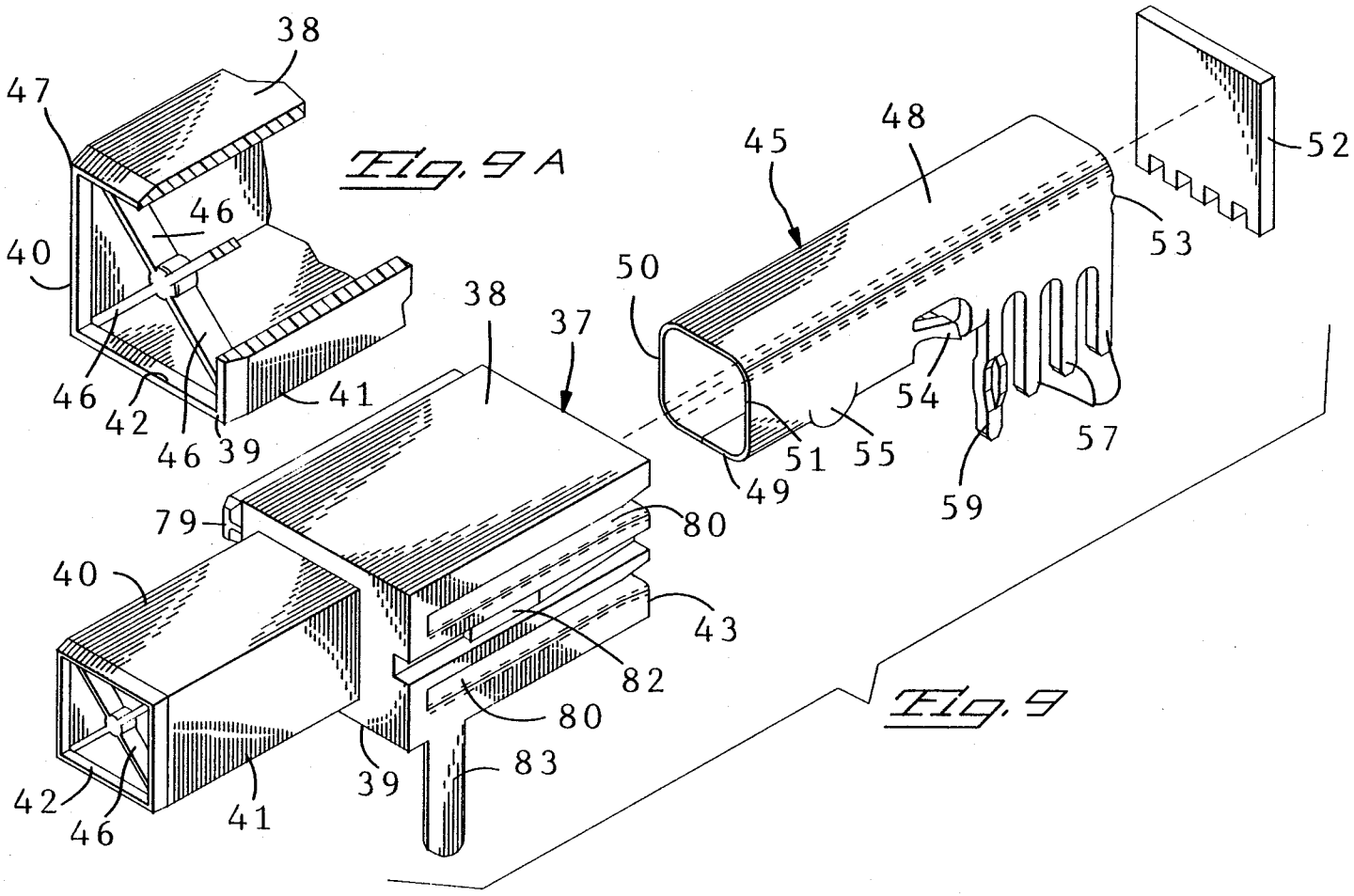
FIG. 9 is an exploded perspective of the plug, female contact member, and cap.
FIG. 9A is an enlarged portion of FIG. 9, showing the plurality of circumferentially-spaced struts on the plug, constituting a second guard means to prevent finger insertion into the plug.
Figure 10:
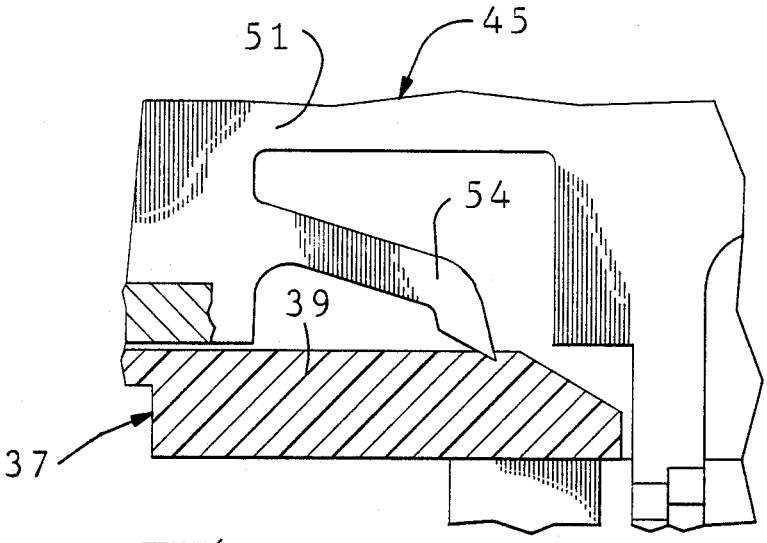
FIG. 10 is an enlarged portion of the female contact member of FIG. 9, showing one of the retention barbs formed on a side wall of the female contact member, the retention barb engaging the bottom wall of the plug for retaining the female contact member in the plug.
Figure 11:
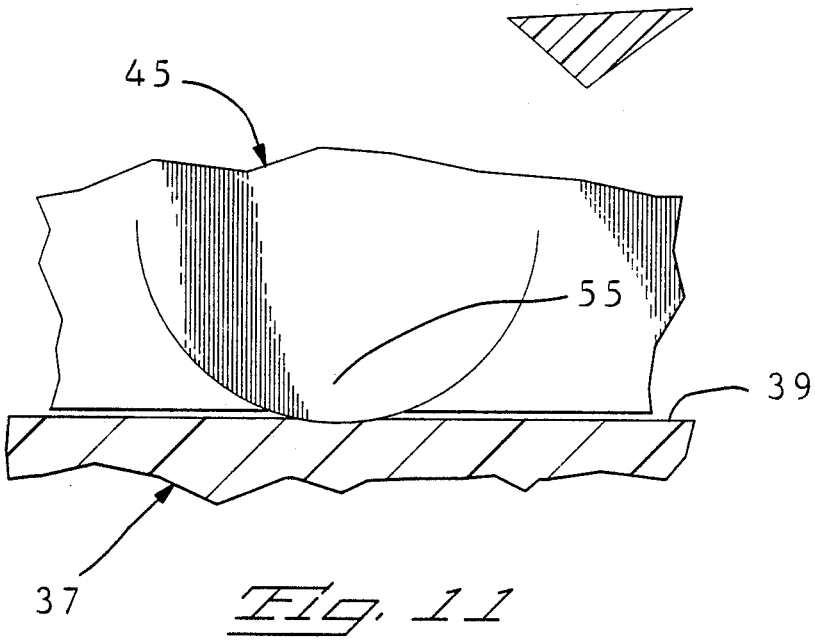
FIG. 11 is a further enlarged portion of the female contact member of FIG. 9, showing one of the radiuses stabilizing portions formed on a respective side wall of the female contact member and engaging the bottom wall of the plug to preclude a rocking movement of the female contact member in the plug about an axis connecting the respective retention barbs, the axis being transverse with respect to the plug.

With reference to FIGS. 9–11, the plug 14 includes a housing 37 which is substantially tubular and has a substantially rectangular cross-section, such that the housing 37 includes a top wall 38, a bottom wall 39, and a pair of respective parallel side walls 40 and 41. The housing 37 has an open forward end 42 and an open rearward end 43. The housing 37 further has an internal ledge 44 formed thereon as more clearly seen in FIG. 4A.

A female contact member 45 is slidably received through the open rearward end 43 of the plug housing 37 and lodges against the internal ledge 44, thereby providing a stop means for limiting the slidable insertion of the female contact member 45 within the plug housing 37. The plug housing 37 has a plurality of struts 46, as shown more clearly in FIGS. 9 and 9A; and in the preferred embodiment, there are four (4) struts 46 circumferentially spaced at approximately 90 degrees from each other and integrally joined with the respective walls 38–41 of the plug housing 37 at the respective corners thereof, as at 47. The struts 46 comprise a second guard means; and as shown more clearly in FIG. 4A, prevent one's finger F', from being inserted through the open forward end of 42 of the plug housing 37 to engage the female contact member 45 therein. It will be appreciated that the plug housing 37 with its struts 46 comprises a unitary component integrally molded from a suitable dielectric material.

The female contact member 45 is tubular and substantially rectangular and includes a top wall 48, a bottom wall 49, and a pair of respective parallel side walls 50 and 51 and is nested within the plug housing 37 and is supported therein by the respective walls thereof. Once the female contact member 45 is slidably inserted through the open rearward end 43 of the plug housing 37, a cap 52 is secured within the open rearward end 43. The cap 52 engages a pair of barbs 53 on the female contact member 45. Cap 52 is ultrasonically welded (or otherwise suitably secured) to the plug housing 37. Preferably cap 52 is provided with stand off means at 53A to provide access to posts 57 during the soldering process.

With reference again to FIG. 3, and with further reference to FIG. 10, the parallel side walls 50 and 51 of the female contact member 45 have respective lanced-out retention barbs 54 formed thereon, the retention barbs 54 being downwardly and rearwardly inclined. As the female contact member 45 is slidably inserted into the plug housing 37, the retention barbs 54 glide or "ski" along the dielectric material of the plug housing 37; and when the female contact member 45 engages the internal ledge 44, so that further insertion of the female contact member 45 is precluded, the retention barbs 54 then dig down into the plug housing 37 and preclude rearward movement of the female contact member 45 out of the plug housing 37.

Thus, the contact is secured within the housing—in this case, the female contact member 45 within the plug housing 37—with a maximum retention and a minimum damage to the housing. This arrangement is low stress, high retention, and functions regardless of the housing material and its hardness. The purpose of this latching effect is to secure the contact in a housing which, preferably, is made from a relatively hard and incompressible material. It functions by riding over the material as the contact is inserted into the housing. The latching effect of the retention barbs 54 is achieved by residual stresses and, by design, always digs in and hence provides a further resistive force to preclude a backing-out of the contact.

The female contact member 45 further has a pair of stabilizing portions 55 lanced-out of the respective parallel side walls 50 and 5! thereof forwardly of the respective retention barbs 54. These stabilizing portions 55 are radiused, as shown more clearly in FIG. 1, so as to be convex with respect to the bottom wall 39 of the plug housing 37. The respective radiused stabilizing portions 55 engage the bottom wall 39 with a slight interference fit, such that the stabilizing portions 55 tend to prevent the female contact member 45 from rocking or pitching within the plug housing 37 about an imaginary axis connecting the retention barbs 54 transversely of the plug housing 37.

With reference again to FIG. 3, the bottom wall 39 of the plug housing 37 has a slotted opening 56 formed therein between the open rearward end 43 of the plug housing 37 and rearwardly of the engagement of the retention barbs 54 with the plug housing 37. A plurality of solder posts 57 are formed on the respective parallel side walls 50 and 51 of the female contact member 45, depend therefrom, and extend through the opening 56 in the bottom wall 39 of the plug housing 37 to engage within respective openings 58 in the power supply board 11. The electrical engagement of the solder posts 57 with the contacts and circuitry on the power supply board 11, being conventional, has been omitted herein for ease of illustration. In the preferred embodiment, these solder posts 57 are arrayed in two (2) parallel rows of three (3) solder posts 57 each. It is to be understood that other types of posts or legs and physical arrangement of same may be used in place of the two parallel rows.

Respective retention members 59, preferably compliant pins similar to those previously described, are formed on the respective side walls 50 and 51 of the female contact member 45 and depend therefrom forwardly of the solder posts 57. These retention members 59 are received within respective openings 60 in the power supply board 11 and are lodged therein for providing mechanical rigidity and support for the female contact member 45, the top wall 48 of which is supported solidly against the top wall 38 of the plug housing 37. More specifically, when the female contact member 45 is inserted in the plug housing 37, the non-current carrying retention members 59 absorb the stresses which otherwise would be transferred to the solder posts 57 (and to the solder joints therewith) and the top wall 48 of the female contact member 45 is always in contact with the top wall 38 of the plug housing 37 to permit efficient transfer of forces to the retention legs 59 during insertion onto the power supply board 11.

Figure 3:
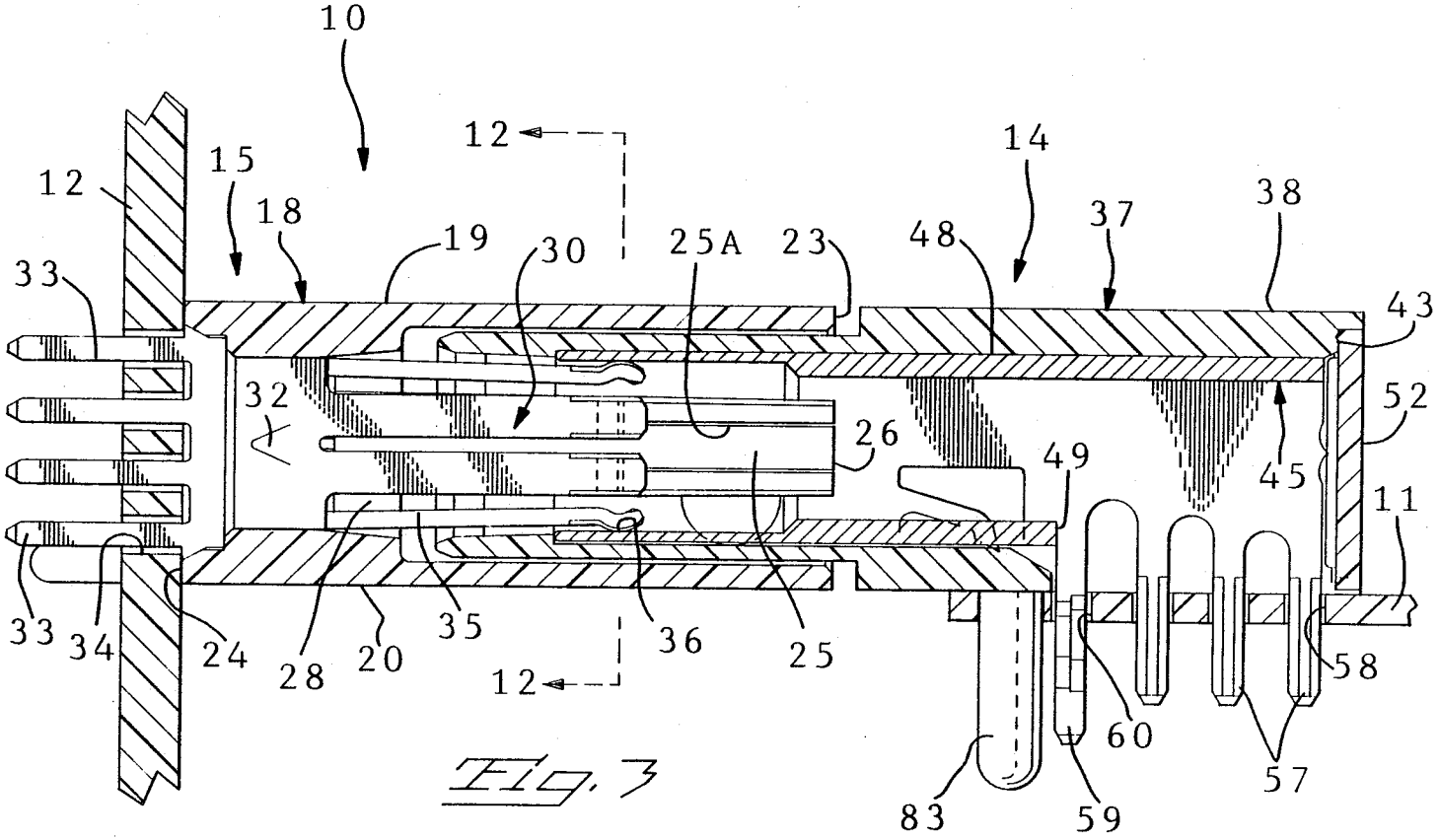
FIG. 3 is a longitudinal section, taken along the lines 2—2 of FIG. 1 and drawn to an enlarged scale, and showing a male contact member in a receptacle engaging a female contact member in a plug, wherein the plug has a plurality of solder posts for engaging a printed circuit board, and wherein the receptacle is mounted on a "mother" board or backplane.
Figure 12:
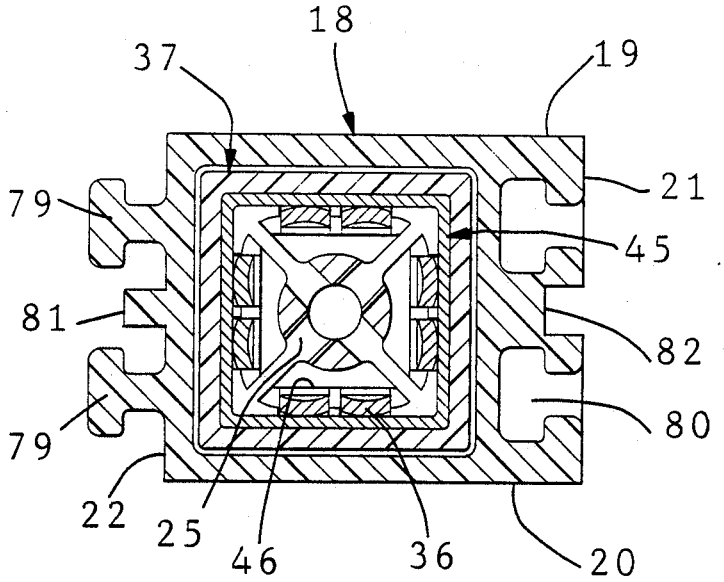
FIG. 12 is a further cross-section, taken across the lines 12—12 of FIG. 3, and showing, first, the plug received in the receptacle and, second, the spring-finger contact elements of the male contact member engaging the female contact member.
Figure 17:
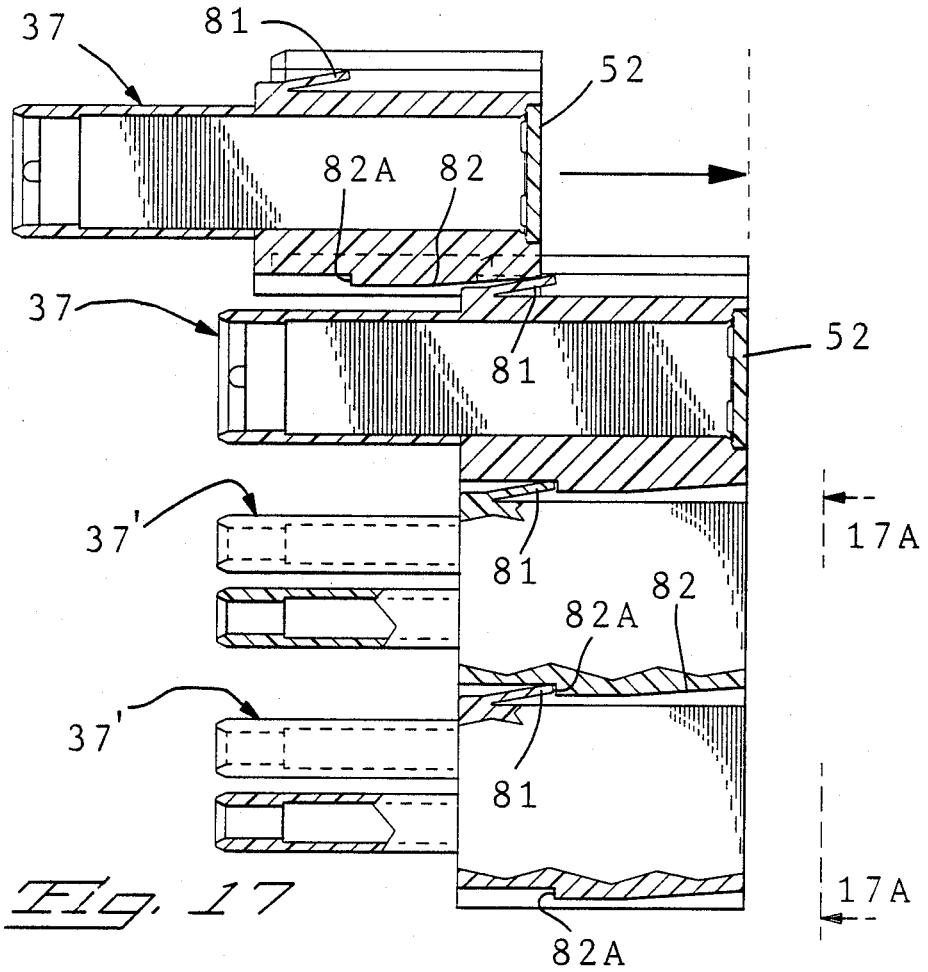
FIG. 17 is a top plan view partially in section of several modules, illustrating the latching means.

With reference to FIGS. 3 and 17, the compliant beam spring-finger contact elements 35 pass between the second struts 46 of the plug housing 37, as the plug 14 is received within the receptacle 15, and the spherical ends 36 of the contact elements 35 engage the female contact member 45, as shown more clearly in FIG. 12. The spring-finger contact elements 35 constitute cantilevered compliant beams, and the spherical ends (or tips) 36 of the contact elements 35 assure a good electrical contact with the female contact member 45 (thus providing a surface contact rather than a line contact) despite any bending or torsional stresses on the respective contact elements 35. These compliant beams are sufficiently long and narrow to provide torsional displacement at the tip to further guarantee maximum contact. Deformation of the beams during manufacturing is minimized to prevent stress buildup, which otherwise stiffens the beam and decreases performance and reliability. Duplex plating may be used on the contact elements 35; preferably silver is plated on the tips 36 for superior electrical and mechanical performance; and tin is used on the solder posts 33 for optimum solderability. The relatively large number of compliant-beam spring-finger contact elements 35 on the male contact member 30 provides for a minimal constriction resistance and maximum reliability.

Figure 13:
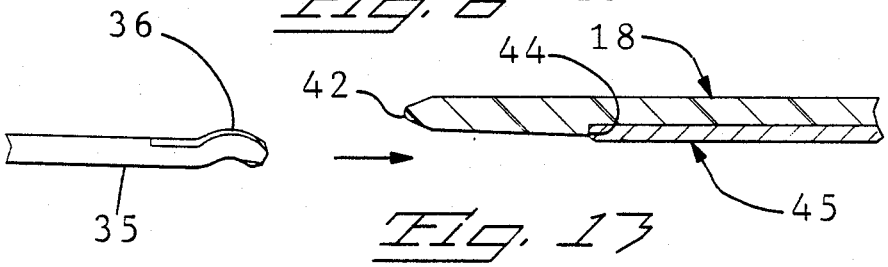
FIG. 13–15 are schematic sequence views, drawn to an enlarged scale, and showing: first, one of the compliant-beam spring-finger contact elements of the male contact member about to engage the dielectric housing of the plug (FIG. 13); second, the spring-finger contact element engaging the plug housing, such that the contact element is deflected inwardly (FIG. 14); and, third, the contact element engaging the female contact member (FIG. 15), wherein the end of the contact element is coined to provide a spherical surface convexly disposed relative to the female contact member, thereby assuring a surface contact therebetween despite the occurrence of any torsional stresses on the contact element.
Figure 14:
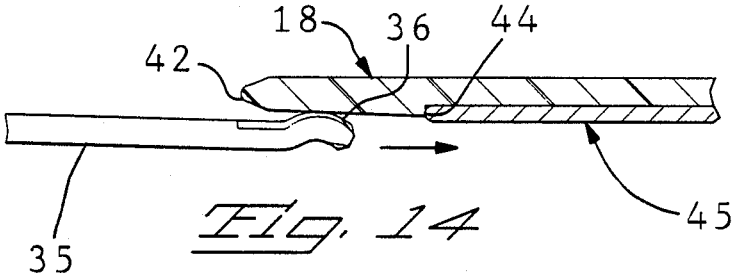
Figure 15:
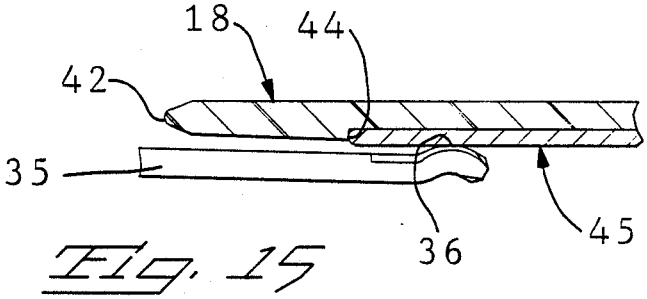

With reference to the schematic sequence views of FIGS. 13–15, the spring-finger contact elements 35 engage the dielectric material at the open forward end 42 of the plug housing 37 and are depressed or deflected inwardly of the male contact member 30, as shown more clearly in FIG. 14. Thereafter, the contact elements 35 ride along the insulative dielectric material and ultimately engage the conductive metal material of the female contact member 45, as shown more clearly in FIG. 15.

As previously noted, the plug housing 37 and the receptacle housing 18 are each integrally molded of a suitable dielectric material. Additionally, the male contact member 30 and the female contact member 45 may each be milled out of solid stock, or otherwise produced from sheet metal which is stamped and formed, as may be desired.

Figure 16:
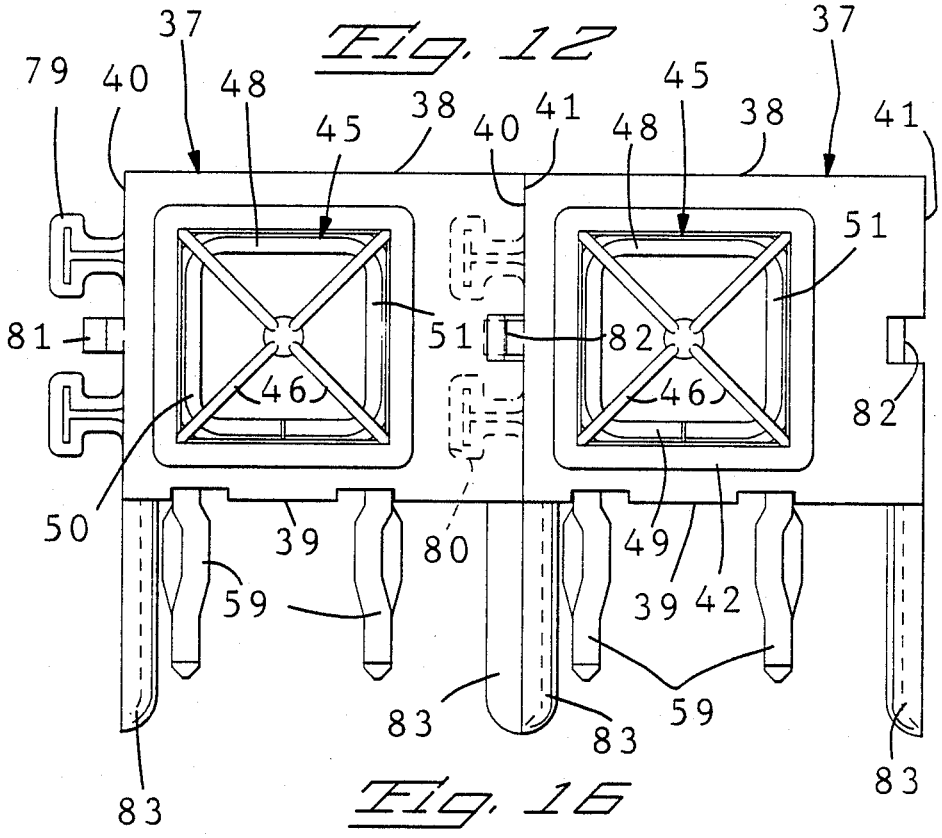
FIG. 16 is an end view of a pair of modules, showing the latching therebetween.
Figure 17A:
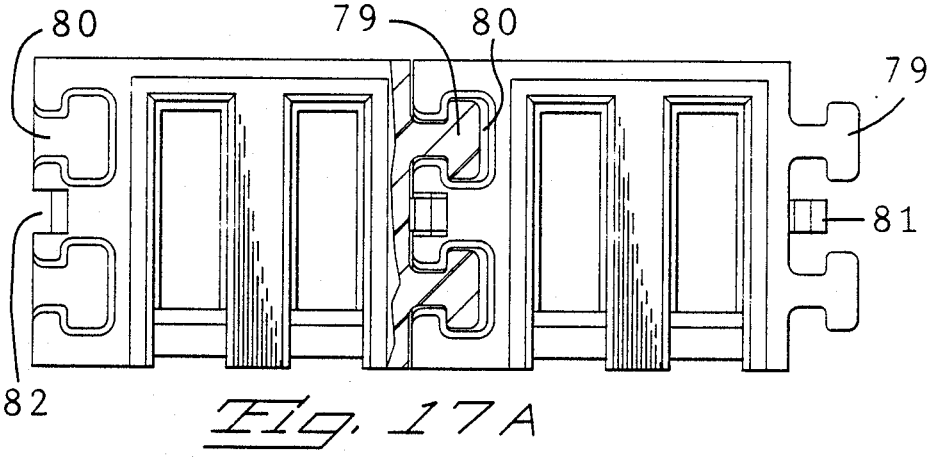
FIG. 17A is a back view of two of the latched modules taken along line 17A—17A of FIG. 17.

With reference again to FIGS. 5 and 9, and with further reference to FIGS. 16–17A, each of the modules (such as the plug 14 and the receptacle 15, respectively) is provided with a pair of spaced apart longitudinal keys 79 formed externally on one side of the respective module. The other side of the respective module has a pair of complementary spaced-apart longitudinal keyways 80 formed thereon. The keys 79 on one module are adapted to be slidably received within the keyways 80 on an adjacent module, and vise-versa, as the respective modules are slidably received together. Each of the keys 79 and keyways 80 has a substantially "T" cross-section, thereby providing a "dogbone" arrangement for keying one module to an adjacent module. A cantilevered beam 81 is formed between the keys 79, and a complementary longitudinal ridge 82 is formed between the keyways 80. Ridge 82 is formed as an inclined plane (either partially or completely) beginning at the rearward end portion of the housing and terminating short of the forward portion of the housing as shown more clearly in FIG. 17. As the adjacent modules are slidably engaged, compliant beam 81 is deflected inwardly and rides over ridge 82 until it reaches the end of ledge 82 where it moves outwardly to engage end 82A of ridge 82 interlock (as shown more clearly in FIG. 30) to latch the adjacent modules together. Thereafter, a pin or other implement (not shown) may be inserted between the adjacent modules to deflect the cantilevered beam 81, thereby disengaging the latching between the adjacent modules and allowing the modules to be slidably separated from each other.

The linear latching arrangement of the modular connectors facilitates an automatic assembly, self-centering design. The latching mechanism (provided by the "dogbone" keys 79 and keyways 80) slide together in a linear fashion and results in a connection of superior strength. The modules also incorporate the split mounting posts 83 to provide a sequence positioning on the PC board. The contacts (as for example, the female contact member 45) is inserted through the back of its respective module by automated assembly equipment. After insertion, an end cap 52 is ultrasonically welded to the back of the module to prevent an inadvertent engagement with the metal contact. Upon insertion of the module into the printed circuit board, the non-current carrying retention leg (or legs) 59 retains the module on the board and absorb any stresses which may otherwise be transferred back to the solder posts (or solder joints) 57. The module is designed to be pressed onto the board with a simple hand press; and the contact is disposed in the module so that the contact is always in engagement with the top wall—in this case, the top wall 38 of the plug housing 37—which permits an efficient transfer of the insertion pressure to the contact retention leg 59.

With reference again to FIGS. 3 and 16, each of the modules (such as the plug 14 or the receptacle 15) has a pair of split posts 83 formed integrally with the respective side walls of the module and depending downwardly therefrom. The split post 83 on one of the side walls of one of the modules cooperates with a split post 83 on the other side wall of an adjacent module, when the modules are slidably engaged and latched together as previously described, to form a completed post; and as the modules are stacked together in an array, respective pairs of completed posts are formed. These pairs of completed posts are used for alignment purposes in the overall electronic assembly of the various components. Preferably, each split post 83 is formed as a half-post (that is, half of a cylinder) so that completed cylindrical posts are formed when the adjacent modules are stacked together.

This arrangement allows a self-centering of each individual module in a modular connector array as the module is assembled to a printed circuit board, thereby minimizing the tolerance build-up effect in the modular system. On a conventional post/housing, the centerline of the housing must be dimensioned from the post and is subject to tolerance interaction. With the present invention, however, the housing centerline is implied and is independent of tolerances. The only dimension which directly effects the movement of the housing centerline away from the hole centerline is the clearance between the hole and post. A slight interference at worst conditions always assures accurate location. If desired, webs may be added to the split posts (or legs) 83, which would result in an interference throughout the full range of clearances between post and hole. Furthermore, the split post configuration reduces the number of holes required in the board thus permitting closer spacing of traces on the board.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A matable connector assembly comprising:

a receptacle formed from an insulative material, the receptacle having a forward open end;

a male contact member formed from a conductive material and secured within the receptacle, the male contact member having a plurality of spring finger contact elements, each comprising a cantilevered beam extending forwardly within the receptacle and terminating prior to the forward open end of the receptacle;

first guard means carried by the receptacle, extending substantially adjacent to the forward open end thereof, and disposed within the plurality of contact elements of the male contact member for preventing insertion of a finger through the forward open end of the receptacle to engage the male contact member therein, the first guard means comprising a cylindrical sleeve disposed within the receptacle, the cylindrical sleeve having a rearward end portion integrally joined to the receptacle by a plurality of struts;

a plug formed from an insulative material and adapted to be slidably received and partially nested within the receptacle, the plug having a forward open end;

a female contact member formed from a conductive material and secured within the plug, the female contact member having a forward portion terminating prior to the forward open end of the plug;

second guard means carried by the plug substantially between the forward portion of the female contact member and the forward open end of the plug for preventing insertion of a finger through the forward open end of the plug to engage the female contact member therein, whereby as the plug is slidably received within the receptacle, the first guard means on the receptacle is received within and passes through the second guard means on the plug, and the plurality of contact elements on the male contact member in the receptacle are received within the open forward end of the plug, are deflected inwardly thereof, and pass through the second guard means on the plug to be received within and engage the forward portion of the female contact member in the plug.

2. The connector assembly of claim 1, wherein the receptacle has a rectangular cross-section including four side walls joined together at four corners, respectively, wherein there are four struts spaced substantially at ninety degrees with respect to each other, and wherein the struts are integrally joined with the receptacle at the corners thereof, whereby respective pairs of spring finger contacts are disposed between adjacent struts.

3. The connector assembly of claim 2, wherein each side wall of the rectangular receptacle has an internal longitudinal rib formed thereon rearwardly of the struts, and wherein each side wall of the male contact member has a lanced-out tab cooperating with a respective longitudinal rib, thereby retaining the male contact member within the receptacle.

4. The connector assembly of claim 1, wherein the plug has a rectangular cross-section including side walls joined at four corners and wherein the female contact member has a rectangular cross-section complementary to that of the plug and side walls of the female contact member include retention means for retaining female contact member in the plug.

5. The connector assembly of claim 4, wherein the side walls of the female contact member are further provided with respective stabilizing portions forwardly of the respective retention means, each of the stabilizing portions being formed on a radius disposed convexly with respect to the bottom wall of the plug, whereby the respective stabilizing portions substantially prevent a rocking movement of the female contact member about a transverse axis between the respective retention means.

6. The connector assembly of claim 4, wherein the second guard means on the plug comprises a plurality of second struts integrally joined with the four corners of the plug spaced at substantially ninety degrees from one another, wherein respective pairs of spring finger contacts of the male contact member are received between respective pairs of the second struts, and wherein the cylindrical sleeve of the first guard means has a plurality of longitudinal slots formed therein, the longitudinal slots being circumferentially spaced substantially at ninety degrees from one another to receive the respective second struts on the second guard means as the plug is slidably received in the receptacle.

7. A matable connector assembly comprising:

a receptacle formed from an insulative material, the receptacle having a forward open end;

a male contact member formed from a conductive material and secured within the receptacle, the male contact member having a plurality of contact elements extending forwardly within the receptacle and terminating prior to the forward open end of the receptacle, said contact elements comprising eight spring finger contacts arranged in a rectangular array, a pair of said spring finger contacts being disposed at each side of the rectangular array, each said spring being formed as a cantilevered compliant beam;

first guard means carried by the receptacle, extending substantially adjacent to the forward open end thereof, and disposed within the plurality of the contact elements of the male contact member for preventing insertion of a finger through the forward open end of the receptacle to engage the male contact member therein;

a plug formed from an insulative material and adapted to be slidably received and partially nested within the receptacle, the plug having a forward open end;

a female contact member formed from a conductive material and secured within the plug, the female contact member having a forward portion terminating prior to the forward open end of the plug;

second guard means carried by the plug substantially between the forward portion of the female contact member and the forward open end of the plug for preventing insertion of a finger through the forward open end of the plug to engage the female contact member therein, whereby as the plug is slidably received within the receptacle, the first-guard means on the receptacle is received within and passes through the second guard means on the plug, and the plurality of contact elements on the male contact member in the receptacle are received within the open forward end of the plug, are deflected inwardly thereof, and pass through the second guard means on the plug to be received within and engage the forward portion of the female contact member in the plug.

8. The connector assembly of claim 1, wherein the plug has an internal ledge formed therein rearwardly of the second guard means in the plug, and wherein the forward portion of the female contact member engages the internal ledge.

9. The connector assembly of claim 1 wherein the receptacle has a substantially rectangular cross-sectional configuration including a top wall, a bottom wall, and a pair of parallel side walls.

10. The connector assembly of claim 1 wherein a plurality of receptacles are arranged in a side-by-side stacked relationship and a plurality of corresponding plugs are arranged in a side-by-side stacked relationship.

11. The connector assembly of claim 10, wherein each of the plurality of the plugs and each of the plurality of receptacles comprises a module, the module having a substantially rectangular cross-sectional configuration including a plurality of walls including at least a first module having a first side wall, and further including a second module having a second side wall adapted to engage the first side wall of the first module and latch thereto, latching means comprising a pair of spaced-apart longitudinal keys formed on the first side wall of the first module, the second side wall of the second module having a complementary pair of spaced-apart longitudinal keyways formed thereon, the pair of longitudinal keyways being adapted to receive the pair of spaced-apart longitudinal keys on the first side wall of the first module, the spaced-apart longitudinal keyways on the second module having a longitudinal ridge therebetween, the ridge beginning substantially at the rearward end of the second module and terminating short of the forward end of the second module, the ridge being formed as an inclined plane increasing from the beginning to the termination thereof, the spaced-apart longitudinal keys on the first module having a compliant cantilevered beam therebetween, the beam beginning substantially at the forward end of the first module and terminating short of the rearward end of the first module, the compliant beam being substantially complementary to the ridge, whereby as the spaced-apart longitudinal keys on the first side wall of the first module are slidably received within the spaced-apart longitudinal keyways on the second side wall of the second module, the compliant cantilevered beam rides up on the ridge and over the end thereof and engages the termination of the ridge to latch the first and second modules together.

12. The connector assembly of claim 11, wherein the plugs and receptacles are formed as a plurality of modules, each of the modules being substantially rectangular and being arranged in a side-by-side stacked relationship, each of the modules having a pair of split posts depending therefrom, whereby in the stacked relationship, each of the split posts mates with a respective split post on an adjacent module, thereby forming therebetween respective completed posts, and wherein an adjacent electronic assembly has complementary holes formed therein to receive the completed respective posts for mechanical alignment between the modules and the assembly.

13. A modular receptacle for a connector assembly, comprising:

a housing molded from a dielectric material, the housing having an open forward end and an open rearward end, a central post disposed within the housing longitudinally thereof, the post having a forward portion and a rearward portion, the forward portion of the post terminating substantially adjacent to the forward end of the housing, a plurality of circumferentially-spaced struts integrally joining the rearward portion of the post with the housing and means for retaining a contact member within the and housing;

a contact member inserted through the rearward end of the housing, the contact member having a plurality of cantilevered compliant-beam contact elements extending forwardly therefrom, wherein the contact elements extend between the plurality of circumferentially-spaced struts and are disposed between the central post and the housing.

14. The modular receptacle of claim 13, wherein each of the contact elements has an end portion coined to form an arc which is convex with respect to the housing.

15. The modular receptacle of claim 13, wherein there are four struts arranged approximately ninety degrees from each other, wherein there are eight contact elements arranged in four pairs, and wherein a pair of contact elements is disposed between an adjacent pair of struts.

16. The modular receptacle of claim 13, wherein a plurality of housings is arranged in a side-by-side stacked relationship, each of the housings having a pair of split posts formed integrally therewith and extending therefrom, including respective first and second split posts, such that the first split post of a respective housing is adapted to mate with the second split post of an adjacent housing to form a completed locating post thereby providing means for self-centering each of the modular receptacles when they are mounted to a substrate and substantially reducing the tolerance problems normally incurred in manufacturing and assembly of the apparatus.

17. A modular electrical connector assembly having a plurality of insulated housings arranged in a side-to-side stacked array, including at least a first housing and a second housing, wherein each of the housings has a substantially rectangular configuration having parallel side walls including a first side wall and a second side wall, and wherein each of the housings further has a forward end portion and a rearward end portion, the assembly further comprising:

latching means between the first side wall of the first housing and the second side wall of the second housing, the latching means including keying means on each of the first and second side walls of the first and second housings, respectively, thereby keying the first and second housings together and preventing relative rotation therebetween as the first and second housings are slidably engaged longitudinally thereof, and the latching means further including cooperating latching means disposed between the keying means on each of the first and second side walls of the first and second housings, respectively; and a pair of split locating posts formed on each of the housings, including first and second split locating posts, such that the first post of a respective housing cooperates with the second post of an adjacent housing to form a completed locating post, thereby substantially reducing the build up of manufacturing tolerances during the assembly of a plurality of housings.

18. The modular connector assembly of claim 17, wherein:

the keying means comprises a pair of spaced-apart longitudinal keys formed on the first side all of the first housing, the second side wall of the second housing being adapted to mate with the first side wall of the first housing and having a pair of spaced-apart longitudinal keyways formed thereon complementary to the pair of spaced-apart longitudinal keys on the first side wall of the first housing; and the latching means comprises a longitudinal ridge disposed between the longitudinal keyways, the longitudinal ridge beginning substantially at the rearward end portion of the second housing and terminating short of the forward end portion of the second housing, the ridge being formed as an inclined plane increasing from the beginning to the termination thereof, and a compliant cantilevered beam disposed between the longitudinal keys, the beam beginning substantially at the forward end portion of the first housing and terminating short of the rearward end portion of the first housing, the cantilevered beam being substantially complementary to the ridge, whereby as the spaced-apart longitudinal keys on the first side wall of the first housing are slidably received within the spaced-apart longitudinal keyways on the second side wall of the second housing, the compliant cantilevered beam ride up on the ridge and over the ridge and engages the forward end thereof to latch the first and second housings together.

19. A modular plug for an electrical connector assembly, comprising:

a housing molded from a dielectric material, the housing being tubular and having substantially rectangular configuration provided with a substantially rectangular cross-section, the housing having top and bottom walls and a pair of parallel side walls, respectively, the housing further having an open forward end and an open rearward end;

a female contact member inserted through the open rearward end of the housing, the female contact member being tubular and having a substantially rectangular cross-section, the contact member having top, bottom and parallel side walls, respectively, the female contact being nested within the housing such that the forward end of the contact member lies proximate an internal ledge formed within the housing and spaced rearwardly from the open forward end of the housing, the ledge limiting the degree of insertion of the contact member into the housing, the contact member further including means extending from at least one wall of the contact member for retaining the member within the housing and means for stabilizing the position of the contact member in the housing to preclude rotation of the contact member about a transverse axis in the housing;

guard means on the housing forwardly of the internal ledge to preclude the insertion of one's finger through the open forward end of the housing to engage the female contact member, the guard means comprising a plurality of angularly radially-spaced struts integrally formed with the housing, the struts inserting at the center of the forward open end of the housing thereby preventing inadvertent access of one's finger into the open forward end of the housing;

other guard means comprising a cap joined to the open rearward end of the housing after the contact member has been inserted through the open rearward end of the housing, thereby preventing a finger from being inserted through the open rearward end of the housing to engage the female contact member, the housing having a wall formed with an opening therein forwardly of the cap, and at least one solder post carried by the contact member and extending therefrom through the opening in the housing; and first and second split locating posts extending from the housing whereby the housings of a plurality of modular plugs are arrangeable in a side-by-side stacked relationship such that the first post of a respective housing cooperates with the second post of an adjacent housing to form a completed locating post, thereby providing means for self centering each of the modular plugs when they are mounted to a substrate and substantially reducing the build up of manufacturing tolerances during the assembly of a plurality of housings.

* * * * *